US006170134B1

(12) United States Patent
Downie et al.

(10) Patent No.: US 6,170,134 B1
(45) Date of Patent: Jan. 9, 2001

(54) SEAT BELT BUCKLE

(75) Inventors: Andrew John Downie; David Burke, both of Carlisle (GB)

(73) Assignee: Breed Automotive Technology, Inc., Lakeland, FL (US)

( * ) Notice: Under 35 U.S.C. 154(b), the term of this patent shall be extended for 0 days.

(21) Appl. No.: 09/155,697

(22) PCT Filed: Apr. 15, 1997

(86) PCT No.: PCT/GB97/01056

§ 371 Date: Feb. 4, 1999

§ 102(e) Date: Feb. 4, 1999

(87) PCT Pub. No.: WO97/38600

PCT Pub. Date: Oct. 23, 1997

(30) Foreign Application Priority Data

Apr. 15, 1996 (GB) ..... 9607796

(51) Int. Cl.[7] ..... A44B 11/26
(52) U.S. Cl. ..... 24/641; 24/633
(58) Field of Search ..... 24/633, 637, 636, 24/639, 640, 641, 642

(56) References Cited

U.S. PATENT DOCUMENTS 5,280,669 * 1/1994 Nanbu et al. ..... 24/633 X

FOREIGN PATENT DOCUMENTS 0679348 2/1995 (DE) .
0507266 7/1992 (EP) .
0680705 8/1995 (EP) .
680705 * 11/1995 (EP) .
2223265 4/1990 (GB) .

* cited by examiner

*Primary Examiner*—James R. Brittain
(74) *Attorney, Agent, or Firm*—Markell Seitzman

(57) ABSTRACT

A pretensioner-proof buckle comprises a buckle for a vehicle safety restraint mechanism, the buckle comprising: a housing (3) having a rectilinear channel for receving a fastening member (2); a latching element (4) mounted within the housing and moveable between a first position in which it engages the fastening member and a second position in which the fastening member is released; a release button (10) operatively connected to the latching element for effecting movement thereof between the first and second positions; a blocking member (5) for engaging the latching element under predetermined conditions to prevent movement of the latching element towards the release position; and an inertial mass (14) pivotally mounted to, and contained within side walls of, the release button (10), the mass being arranged to act on the blocking member under said predetermined conditions to move the blocking member into engagement with the latching element. The blocking member slides into position during the acceleration phase of a pretensioning operation and thus secures the buckle against spurious release earlier than in previously known arrangements.

11 Claims, 2 Drawing Sheets

SEAT BELT BUCKLE

DESCRIPTION

The present invention relates to a seat belt buckle and in particular to a buckle which is resistant to spurious disengagement under high g-forces such as are experienced when a pretensioner which is fitted to the anchorage of a buckle fires under crash conditions.

A seat belt buckle is known from EP 0 384 703 in which a locking element pivots into and out of a position in which a locking projection of the locking element engages an aperture in a tongue to be fastened into the buckle. The locking element is pivoted out of engagement by a translational motion of a buckle release button. In the locking position it is held in place by an overlocking pin guided in slots in the buckle frame and by a spring loaded rocking member which is pivotally mounted on the locking element. The rocking member is inertially balanced to block the overlocking pin in the buckle locked portion under certain inertial conditions.

However this known buckle is not immune to the very high g-forces caused by modern pretensioners acting on a buckle anchorage in a crash.

Improvements to the buckle have thus been suggested to the buckle of EP 0 384 703 in which a further member is used to constrain the overlocking member in its locking position.

Further improvements are disclosed in EP 0 559 403 in which an overlocking plate is slidably held in slots in the release button. Under the high g-forces generated by firing of a pretensioner and specifically by the deceleration forces at the end of the pretensioning stroke, the inertial of the overlocking plate causes it to slide into a position in which it blocks release of the locking element. Once the pretensioning operation is complete the high g-forces subside, and the release button returns under spring pressure to its normal position, releasing the overlocking plate from the locking element and thus buckle release is again enabled on depression of the release button.

The present invention aims to further improve the above mentioned buckle making it faster and more reliable.

According to the present invention there is provided a buckle for a vehicle safety restraint mechanism, the buckle comprising:

- a housing having a rectilinear channel for receiving a fastening member;
- a locking member mounted within the housing and moveable between a first position in which it engages the fastening member and a second position in which the fastening member is released;
- a release button operatively connected to the locking member for effecting movement thereof between the first and second positions;
- a blocking member such as a sliding plate for engaging the latching element under predetermined conditions to prevent movement of the locking member towards the release position; and
- an inertial mass pivotally mounted to, and contained within side walls of, the release button, the mass being arranged to act on the blocking member under said predetermined conditions to move the blocking member to a position in which the locking member is retained in the first position.

The predetermined conditions are preferably those experienced when an acceleration force is present of greater than a predetermined value, for example the acceleration force experienced by the buckle at the onset of a pretensioning operation.

Thus it will be seen that the improved buckle of the invention causes the pretensioner-proof blocking member to move into its blocking position during the acceleration phase of the pretensioning operation, thus securing the buckle against spurious release before the deceleration phase. This is earlier than in the known systems described above in which the blocking action only becomes operative during the deceleration phase and in which there is the danger of the button inertia opening the buckle before the blocking action has become fully operative.

According to a preferred embodiment the buckle further comprises resilient means such as a spring for resetting the mass and the overlocking member when the predetermined conditions are no longer present, for example when the forces associated with the pretensioning operation are dissipated.

For a better understanding of the invention and to show how the same may be carried into effect, reference will now be made to the accompanying drawings in which.

Figure 1:
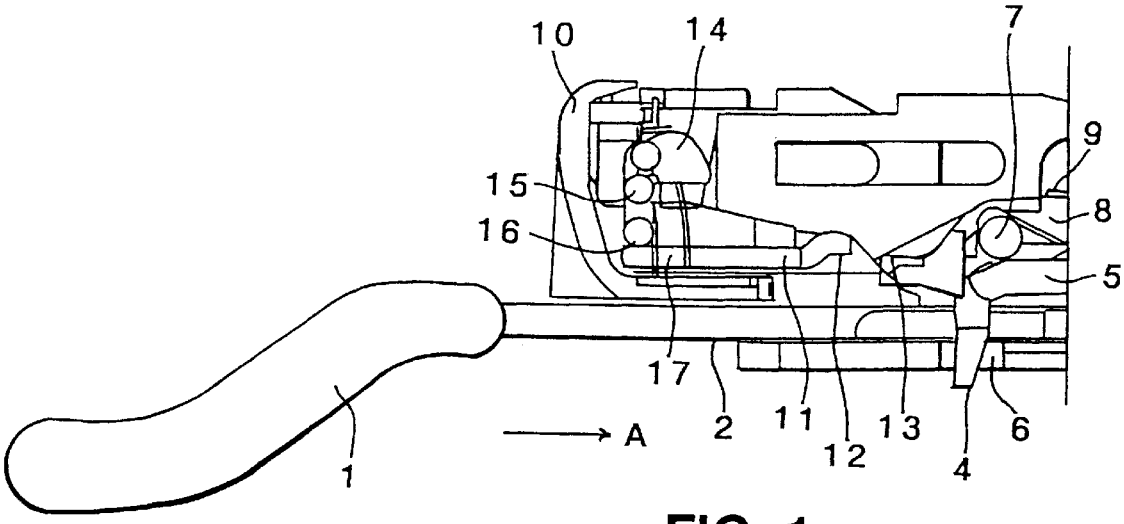
FIG. 1 is a cross-section of a buckle according to the present invention showing the position of components under normal use with the tongue fastened.
Figure 2:
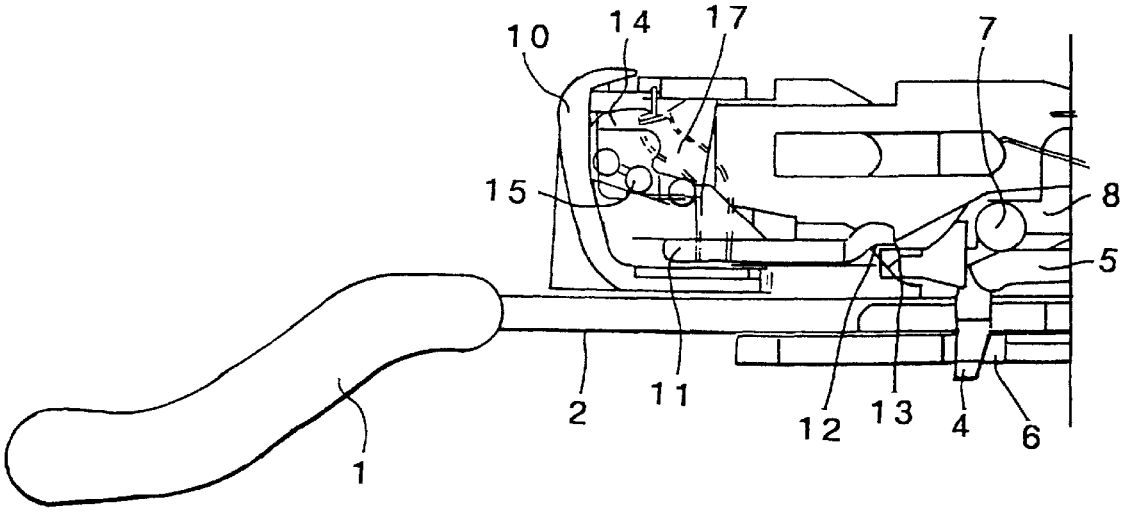
FIG. 2 is a cross-section of the buckle of FIG. 1 under pretensioning conditions.

FIGS. 1 and 2 show seat belt webbing 1 attached to a buckle tongue 2 engaged in a fastening member in the form a rectilinear passage in a buckle frame 3 by means of a locking projection 4 of locking member 5 passing through aperture 6 in the tongue 2.

The locking member 5 is pivoted at its other end (not shown) so that the projection 4 can be moved into and out of aperture 6 in a plane generally perpendicular to the plane of the tongue passage. It is held in locking engagement by an overlocking pin 7 guided in slots in the buckle frame and secured in the locking position by a pivoted rocking member 8 and leaf spring 9 which has two arms which act respectively on the rocking member 8 and on the overlocking pin 7 in a locking direction.

A release button 10 is slidably mounted in the frame and is resiliently biased away from the buckle release position. The release button carries a sliding plate 11 in slots along the inside of its casing. The sliding plate 11 is free to move under inertial forces and is guided by the slots such that movement is restricted to a plane parallel to the plane of the tongue passage. The inner end of the sliding plate 11 is bent to form a raised ledge 12 and the movement of the plate is such that this ledge 12 can over-ride the outermost edge 13 of the rocking member 8 as is shown in FIG. 2.

In this position the rocking member 8 is retained in a position in which it prevents movement of the overlocking pin 7 which in turn retains the locking projection 4 in engagement with the tongue aperture, preventing release of the seat belt.

Also mounted in the button 10 is a mass 14 which pivots in longitudinal slots, about axis 15. The mass 14 has a bulbous, asymmetric head part 30 and off-centre downwardly extending tail parts 31 on which are located contact faces 16, for pushing the plate 11 into position.

A calibration spring 17 is connected between the sliding plate 11 and the release button 10 for resetting the mechanism by ensuring that the mass 14 and the sliding plate 11 return to their normal positions when a pretensioning operation is complete.

Figure 3:
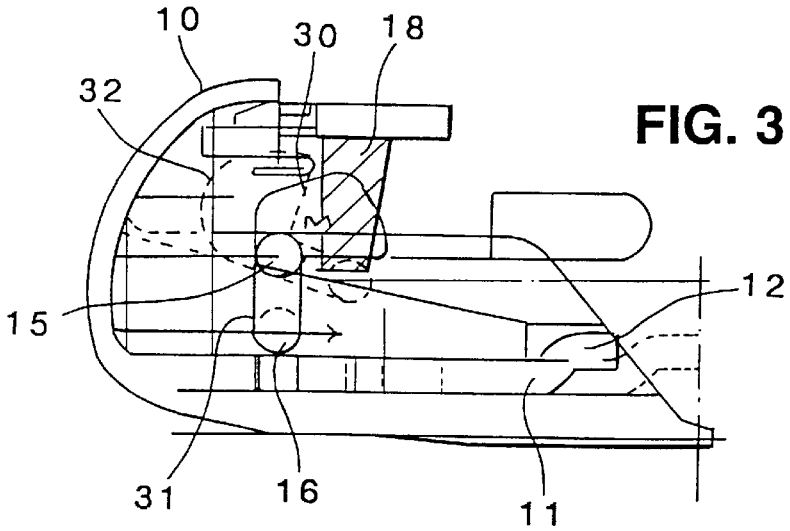
FIG. 3 is an enlarged cross-section of part of FIG. 1.

In FIG. 3 like parts are denoted by like reference numerals. This Figure shows a stop member 18 extending from the "top" of the release button. The mass 14 rests against this, as shown by the broken line 32, at the end of the pretensioning stroke holding the plate in the locked position.

Figure 4:
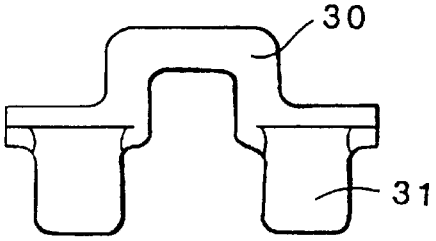
FIG. 4 is a front view of the inertial mass of FIGS. 1 to 3.
Figure 5:
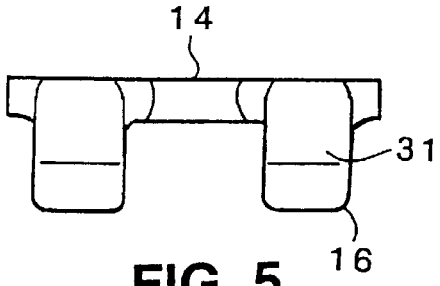
FIG. 5 is a top view of the mass of FIG. 4.
Figure 6:
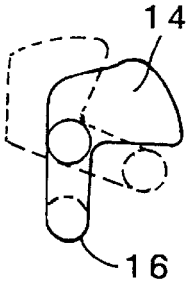
FIG. 6 is a side view of the mass of FIGS. 4 and 5.

The shape and proportions of the mass 14 are seen in FIG. 4 (front view) FIG. 5 (top view) and FIG. 6 (side view). The asymmetric head part 30 is at upper side and the mass 14 extends downwardly into two splayed tail parts 31 on which are located contact faces 16.

Operation of the buckle is as follows.

At the start of a pretensioning operation the buckle experiences a high acceleration force in direction A as it is pulled back to take slack out of the fastened seat belt. This force moves the whole buckle head in the direction A. Since the inertia of the head of the mass 14 is higher than the tail part, it lags behind the tail and thus the mass 14 pivots about point 15 (anti-clockwise as seen in the Figures) to the position shown in FIG. 2. The tail part swings forward relative to the other components of the buckle and contact faces 16 urge the sliding plate 11 in the direction A faster than the buckle head itself. Hence ledge 12 engages rocking member 13 and retains the buckle fastened during the pretensioning stroke.

At the end of the pretensioning stroke, the buckle head abruptly stops moving and the components then experience deceleration forces. The button 10 for example has inertia and keeps moving in the direction A after the buckle head has stopped. This tends to disengage the buckle because the forces which normally cause disengagement of the buckle will operate to tend to lift the rocker 8 and thus the locking member 5 so as to lift projection 4 out of the tongue aperture 6 and enable tongue release. However due to the engagement of ledge 12 of sliding plate 11 on the end of the rocker 8, the projection is held fast in engagement with the tongue and no spurious release occurs.

As the pretensioner forces dissipate at the end of the stroke, and all components of the buckle come to rest, then the calibration spring 17 acts on the mass 14 to return it to the normal vertical position shown in FIG. 1. The calibration spring 17 also acts on sliding plate 11 to slide it back in the opposite direction to A back to the position shown in FIG. 1 where it no longer retains rocker 8 in the buckle fastened position.

Thus the buckle can operate normally again under the action of the button 10.

What is claimed is:

1. A buckle for a vehicle safety restraint mechanism, the buckle comprising:

a housing having a rectilinear channel for receiving a fastening member;

a locking member mounted within the housing and moveable between a first position in which it engages the fastening member and a second position in which the fastening member is released;

a release button operatively connected to the locking member for effecting movement thereof between the first and second positions;

a blocking member, operably connected to the locking member and moveable from an unblocked position to a blocking position, for preventing movement of the locking member towards the second position; and an inertial mass pivotally mounted to, and contained within side walls of, the release button, the mass being arranged to act on the blocking member under predetermined conditions to move the blocking member to its blocking position in which the locking member is retained in the first position.

2. A buckle according to claim 1 wherein the predetermined conditions comprise an acceleration force of greater than a predetermined value, being substantially that experienced by the buckle under pretensioning conditions.

3. A buckle according to claim 1 further comprising resilient means connected to the mass for resetting the mass and the blocking member when the predetermined conditions are no longer present.

4. A buckle according to claim 3, wherein the resilient means is a spring.

5. A buckle according to claim 1, wherein the blocking member comprises a sliding plate mounted in slots in the side walls of the release button.

6. A buckle according to claim 5, further comprising a pivoted rotatable member that is movable from a first pivoted position close to the locking member, to a second pivoted position away from the locking member, wherein the blocking member is movable into engagement with a part of the rotatable member to prevent the rotatable member from moving to its second pivoted position, which is turn prevents the locking member from moving to its second position.

7. A buckle according to claim 1, further comprising an overlocking member for locking the locking member against movement to the second position, under lateral shocks.

8. A buckle for a vehicle safety restraint mechanism, the buckle comprising:

a housing having a rectilinear channel for receiving a fastening member;

a locking member mounted within the housing and moveable between a first position in which it engages the fastening member and a second position in which the fastening member is released;

a release button operatively connected to the locking member for effecting movement thereof between the first and second positions;

a blocking member operable to retain the locking member in the first position; and an inertial mass pivotally mounted to, and contained within side walls, of the release button, the mass being arranged to act on the blocking member under said predetermined conditions to move the blocking member to a position in which the locking member is retained in the first position.

9. A buckle according to claim 8, wherein the blocking member comprises a sliding plate mounted in slots in the side walls of the release button.

10. A buckle according to claim 8, further comprising a pivoted rotatable member that is movable from a first pivoted position close to the locking member, to a second pivoted position away from the locking member, wherein the blocking member is movable into engagement with a part of the rotatable member to prevent the rotatable member from moving to its second pivoted position, which is turn prevents the locking member from moving to its second position.

11. A buckle according to claim 10, further comprising an intermediary member, positionable between the pivoted rotatable member and the locking member for holding the locking member against movement to the second position, under lateral shocks.

* * * * *